United States Patent [19]

Izuta

[11] Patent Number: 4,674,468

[45] Date of Patent: Jun. 23, 1987

[54] JOINT STRUCTURE OF A TAKE-DOWN TYPE ARCHERY BOW

[75] Inventor: Tadao Izuta, Hamamatsu, Japan

[73] Assignee: Nippon Gakki Seizo Kabushiki Kaisha, Japan

[21] Appl. No.: 801,001

[22] Filed: Nov. 22, 1985

Related U.S. Application Data

[62] Division of Ser. No. 404,291, Aug. 2, 1982, Pat. No. 4,574,766.

[30] Foreign Application Priority Data

Aug. 6, 1981 [JP] Japan ..... 56-117220[U]

[51] Int. Cl.[4] ..... F41B 5/00

[52] U.S. Cl. ..... 124/23 R; 124/88

[58] Field of Search ..... 124/23 R, 24 R, DIG. 1, 124/88

[56] References Cited

U.S. PATENT DOCUMENTS 3,874,360 4/1975 Armstrong et al. ..... 124/23 R 3,921,598 11/1975 Helmick ..... 124/24 R 3,942,506 3/1976 Izuta ..... 124/24 R

*Primary Examiner*—Richard C. Pinkham

*Assistant Examiner*—Benjamin Layno

*Attorney, Agent, or Firm*—Lerner, David, Littenberg, Krumholz & Mentlik

[57] ABSTRACT

In a joint structure between each limb and a handle riser of a knock-down type archery bow employing a plug-socket engagement, a two position support is formed by a pair of separate supporter pieces fixed to the face side of the socket, one supporter piece located closer to the socket mouth forming the first support for enabling change in angular position of the limb with respect to the handle riser, and the other supporter piece located closer to the socket bottom forming the second support unmoved by any change in the first support. The absence of holes in the socket walls assures a strong construction without the increase in weight, and the adjustment by the first support causes no disturbance on the originally designed balance of force over the entire construction.

3 Claims, 9 Drawing Figures

JOINT STRUCTURE OF A TAKE-DOWN TYPE ARCHERY BOW

This is a division of application Ser. No. 404,291, filed 08/02/82 and is issued as U.S. Pat. No. 4,574,766.

BACKGROUND OF THE INVENTION

The present invention relates to an improved joint structure of a take-down type archery bow, and more specifically relates to an improvement in construction of a joint structure of an archery bow in which limbs are joined to a handle riser by means of a two position support.

A take-down bow is in general comprised of a handle riser having sockets at distal ends and a pair of limbs each having a plug to be inserted and held firmly in one of the sockets of the handle riser by means of a two position support. Limbs are formed by plastic moulding of fiber reinforced plastics and core materials and, even having same particulars of design, their dimension and/or configuration vary from limb to limb because of inevitable moulding error. When such limbs with variation are coupled to a handle riser to form an archery bow, the bow naturally has an asymmetric construction which tends to seriously disburb balance of force when the string is drawn for shooting. Such unbalanced distribution of force disenables correct shooting of targets and seriously degrades durability of the elements composing the archery bow.

In order to cover this defect inherent to take-down bows, it has been proposed to provide the joint structure of a bow with a function to allow adjustment in angular position of a limb with respect to an associated handle riser in order to obtain optimum balance of force over the entire construction of the bow.

As later described in more detail, one conventional example of this sort employs a two point support for the limb. More specifically, a plug of the limb is received and held firmly in a socket of a handle riser by means of a pair of screw members providing the above-described two point support. This two point support tends to cause significant stress concentration on the screw members when the string is drawn for shooting, and repeated stress concentration causes breakage of the plug, thereby lowering durability of the bow. In addition, transverse holes have to be formed through walls of the socket in order to accommodate the screw members, and presence of such holes wields ill influence on the strength of the socket of the handle riser.

In order to cover this disadvantage, another conventional example of this sort includes a flat strap which is interposed between the plug of the limb and the screw member and dissipates the stress otherwise concentrating on the screw member. Use of such a strap for one of the two supports, however, causes change in the basis for calculation of strength distribution over the entire construction of the bow, thereby complicating correct mechanical designing of the bow construction.

SUMMARY OF THE INVENTION

It is one object of the present invention to remove, in the joint structure of archery bows, troubles conventionally caused by inevitable stress concentration at drawing of strings.

It is another object of the present invention to enable free adjustment in angular position of limbs with respect to an associated handle riser without any ill influence on the initially designed balance of force over the entire bow construction.

In accordance with the basic aspect of the present invention, the two position supports are formed by a pair of separate supporter pieces coupled to the face side of the plug of each limb in surface contact with the face side wall of the socket of an associated handle riser so that mere turning of the supporter piece located closer to the mouth of socket allows adjustment in angular position of the limb with respect to the handle riser without any change in the position of the other supporter piece located closer to the bottom of the socket.

DESCRIPTION OF THE PREFERRED EMBODIMENTS

Figure 1:
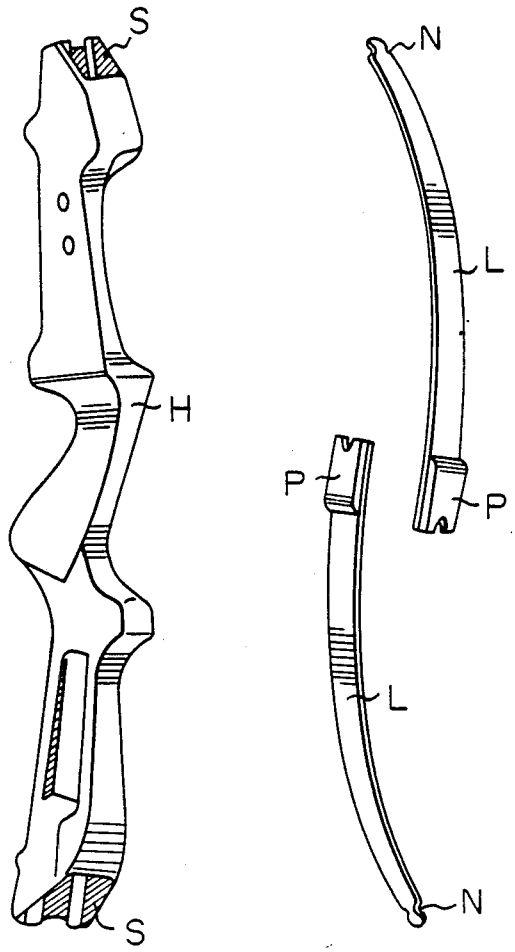
FIG. 1 is a perspective view of a typical take-down type archery bow in a disassembled state.

One example of the most popular take-down type archery bow is shown in FIG. 1 in a disassembled state, in which a take-down bow includes a handle riser H and upper and lower limbs L to be joined to both distal ends of the handle riser H. More specifically, the handle riser H is provided at both distal ends with sockets S receptive of plugs P attached to the proximal ends of the limbs L. For use, the plugs P of the upper and lower limbs L are inserted and fixed in the sockets S of the handle riser H and a string (not shown) is set with tension between string notches N of the limbs L.

Figure 2:
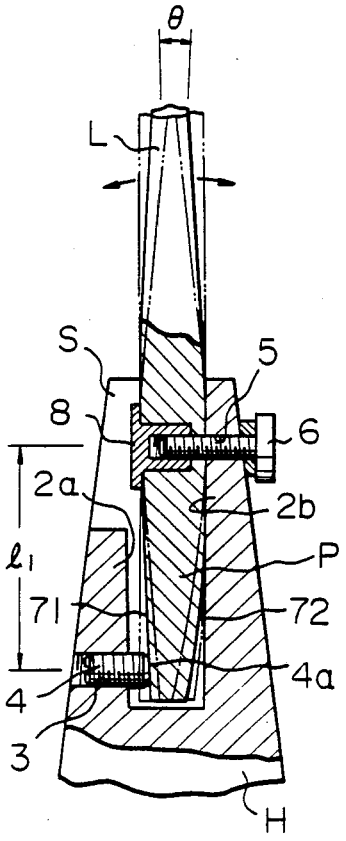
Fig. 2 PRIOR ART
FIGS. 2 and 3 are side views, partly in section, of conventional joint structures of take-down bows.

One example of the conventional joint structure between a handle riser H and a limb R is shown in FIG. 2. In this case, a threaded hole 3 is formed through the back side wall 2*a* of the socket S of the handle riser H and a set screw 4 is screwed into the threaded hole 3. This set screw 4 provides the first support for the plug P of the limb L. At a position closer to the mouth of the socket S, and idle hole 5 is formed through the face side wall 2*b* of the socket S of the handle riser H and a threaded fixer bolt 6 is inserted into the idle hole 5 in screw engagement with a fixer nut 8 embedded in the body of the plug P of the limb L. This fixer bolt 6 provides the second support for the plug P of the limb L. By fastening the set screw 4 and the fixer bolt 6, the plug P is fixedly held in the socket S at two points and the limb L is joined firmly to the handle riser H. Further, by properly varying the extent of fastening of the set screw, the angular position of the limb L with respect to the handle riser H can be adjusted as shown with chain lines over an angle $\theta$. The above-described conventional joint structure, however, is accompanied with an inevitable drawback that, as the angular adjustment of the limb L is carried out by a very thin set screw 4 in point contact with the back side of the plug P, stress concentration tends to occur at the point of contact whilst causing breakage of the plug P of the limb L. In other words, the joint structure of this type seriously lowers durability of limbs.

Figure 3:
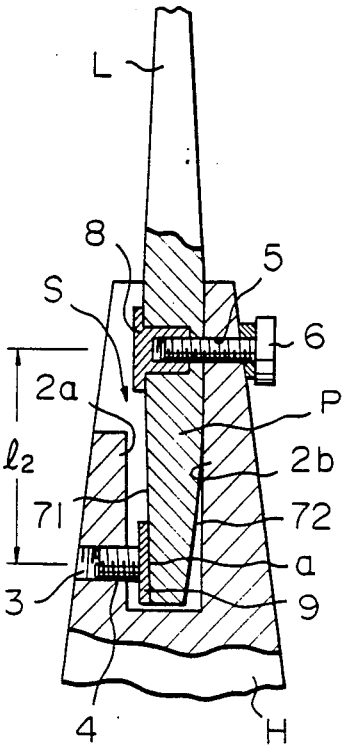
Fig. 3 PRIOR ART

Another example of the conventional joint structure between a handle riser H and a limb L is shown in FIG. 3, which was proposed in order to remove the drawback of the first example. The construction of this joint structure is basically same as that of the first example except for use of a flat strap 9 interposed between the point of the set screw 4 and the back side of the plug P. Stress concentration may be more or less alleviated due to the enlarged surface contact. In this case, however, the point of action "a" by the set screw 4 shifts towards the mouth of the socket S depending on the size of the strap 9. As a consequence, the span $l_2$ between the first and second supports in this example becomes smaller than the corresponding span $l_1$ for the first two supports shown in FIG. 2 and causes increased application of force to the section defining the mouth of the socket. In order to well withstand such increased force under any conditions of use, the section is required to have a thick construction which connects to increased weight of the archery handle riser. It is thinkable to make the socket deeper in order to maintain the initial span. This also requires a thicker construction of the walls of the socket, or use of some fortifiers for the walls of the socket. Either again connects to undesirable increase in weight of the archery handle riser.

Use of screw members for position adjustment of limbs causes a further problem relating to designing of take-down bows. Design of the handle riser plays an important role in commercial value of a take-down type archery bow. Designing of a bow is usually based on mechanical calculation of compression and tension thereof in the shooting direction whilst taking the knocking point as a center of force. The strength of the handle riser on a line connection the knocking point with one of the two supports for the limbs is used as a basis for the strength distribution over the entire body. Presence of the above-described screw members in the socket walls of the handle riser causes change in position of the supports, which disenables easy and correct designing of the handle riser.

As described above, the take-down archery bow in accordance with the present invention has a sort of two position support type joint structure, one near the mouth of the socket and the other near the bottom of the socket.

Figure 4:
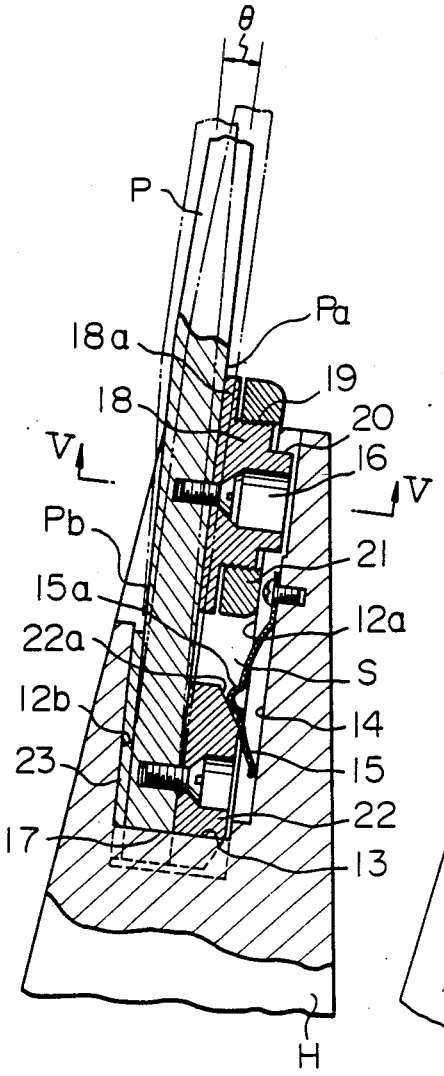
FIG. 4 is a side view, partly in section, of one embodiment of the joint structure in accordance with the present invention.
Figure 6:
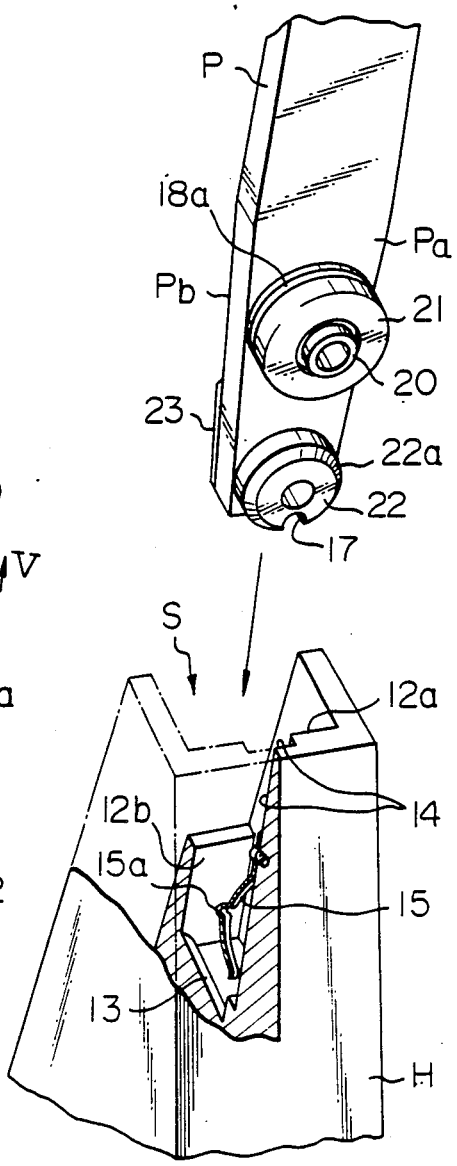
FIG. 6 is a perspective view, partly cut off, of the joint structure shown in FIG. 4 in a disassembled state.
Figure 5:
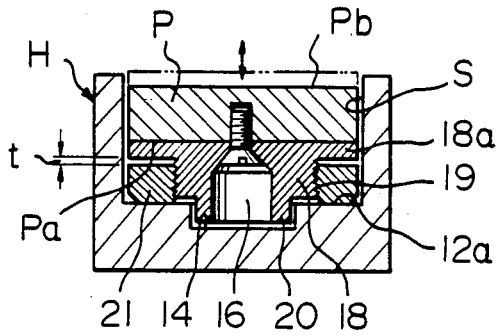
FIG. 5 is a section taken along a line V—V in FIG. 4.

One embodiment of such a joint structure is shown in FIGS. 4 to 6, in which the structure includes, like the conventional examples, a socket S of the handle riser H and a plug P of one of the limbs L, at least the plug P being made of a highly elastic material such as fiber reinforced plastics.

As best seen in FIG. 6, a locker wall 13 projects from the bottom of the socket S whilst spanning the face side and back side walls 12*a*, 12*b* of the socket S. A center guide groove 14 is formed in the face side wall 12*a* running in the longitudinal direction of the socket S. A leaf spring 15 having a center projection 15*a* is fixed at one end to the face side wall 12*a* in the guide groove 14.

In the assembled state, the plug P of the limb L is received and held firmly in the socket S of the handle riser H. The plug P is provided at the bottom end with a locker cutout 17 engageable with the locker wall 13 in the socket S. Near the string side end of the plug P, a first circular supporter piece 18 is fixed to the face side wall Pa of the plug P by means of a set screw 16. This supporter piece 18 has a bottom brim 18*a* whose diameter is roughly equal to the width of the plug P and a thread 19 is formed in the periphery of the circular piece for screw engagement with an adjuster nut 21. The first supporter piece 18 further has a center projection 20 engageable with the center guide groove 14 formed in the face side wall 12*a* of the socket S. The set screw 16 is received in the center axial hole of the first supporter piece 18 and screwed into the plug P. The position of the first supporter piece 18 is chosen so that the adjuster nut 21 should partly project upwards form the mouth of the socket S for easy manual turning. Apparently, the first supporter piece 18 with the adjuster nut 21 forms the first support for the limb L in abutment on the face side wall 12*a* of the socket S. By manually turning the adjuster nut 21 on the first supporter piece 18, the angular position of the limb L with respect to the handle riser H can be freely adjusted over the angle $\theta$ as shown with chain lines in FIG. 4 by changing the gap "t" in FIG. 5.

Near the bottom end of the plug P, a second circular supporter piece 22 is fixed to the face side wall Pa of the plug P by means of a set screw, and provided with an annular chamfer 22*a* for abutment on the center projection 15*a* of the leaf spring 15 on the face side wall 12*a* of the socket S. The second supporter piece 22 apparently forms the second support for the limb L and its abutment on the leaf spring effectively prevents undesirable swing of the limb L relative to the handle riser H. For a more stable holding by the second supporter piece 22, a strap 23 is preferably interposed between the back side wall 12*b* of the socket S and the back side of the plug P.

When the above-described joint structure of the present invention is employed, no transverse holes are present in either side wall of the socket S of the handle riser, and absence of such holes assures a stronger construction of the socket. In addition, support by surface contact well prevents stress concentration on any related elements. Further, adjustment in the angular position of the limb L with respect to the handle riser H can be carried out merely by axially turning the first supporter piece 18, i.e. the first support, located near the mouth of the socket S without any change in position of the second supporter piece 22, i.e. the second support. This fixes the basis for strength destribution and greatly simplifies mechanical designing of the take-down bows.

Figure 7:
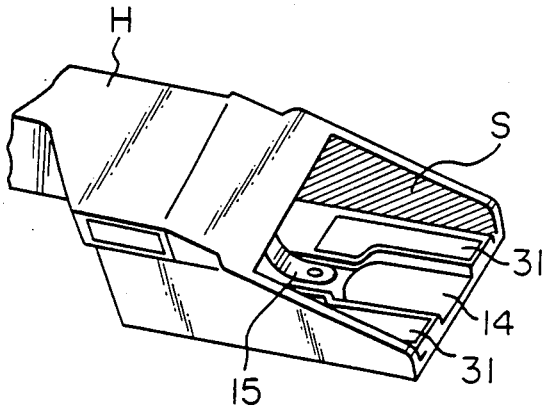
FIG. 7 is a fragmentary, perspective view of another embodiment of the joint structure in accordance with the present invention.
Figure 8:
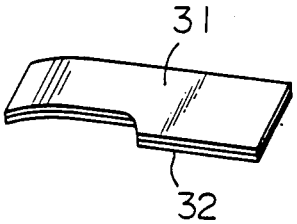
FIG. 8 is a perspective view of a strap usable for the joint structure shown in FIG. 7 for tiller height adjustment.

Another embodiment of the joint structure in accordance with the present invention is shown in FIGS. 7 and 8.

Figure 9:
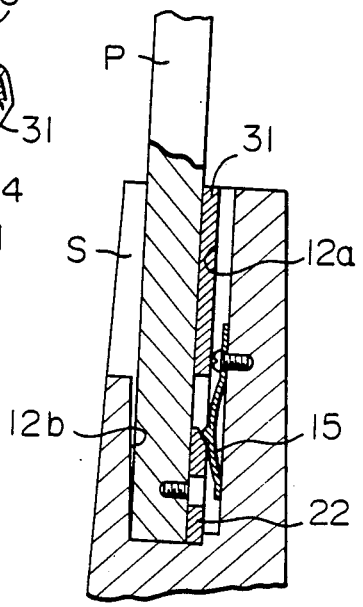
FIG. 9 is a side view, partly in section, of the joint structure shown in FIGS. 7 and 8 in an assembled state.

The joint structure includes a pair of flat, metal spacers 31 bonded to the face side wall 12*a* of the socket S on both sides of the center guide groove 14. One example of such a spacer 31 is shown in FIG. 8, in which the spacer 31 is accompanied with a bonding tape 32 for easy attachment to the socket wall 12*a*. In the assembled state of the archery bow, the spacer 31 is clamped between the plug P and the face side wall 12*a* of the socket S. By using different spacers of different thicknesses, the gap "t" shown in FIG. 5 can be freely changed as desired for tiller height adjustment. Preferably, spacers of a thickness in a range from 0.1 to 0.3 mm are prepared for free replacement by archers. More specifically, as shown in FIG. 9, the plug P of the limb abuts on the spacers 31 provided on the face side wall 12*a* of the socket S at a position close to the mouth of the handle riser. This constitutes a first support for the limb L.

The plug P is also supported at its end by the back side wall 12*b* of the socket S. This constitutes a second support for the limb L. Although the joint structure shown in FIG. 9 is provided with the second circular supporter piece 22 in combination with the leaf spring 15 as that shown in FIG. 4 for stabler second support, the joint structure basically operates as expected even without these elements.

I claim:

1. A take-down type archery bow comprising a handle riser having a socket at each end thereof, and a pair of limbs each having a plug, each limb being releasably secured within an associated socket of said handle riser by a two point support, said two point support including an elastic member coupled to the face side wall of said socket, a first supporter piece disposed on the face side of said plug near the mouth of said socket, a second supporter piece fixed to said face side of said plug remote from the mouth of said socket and having a chamfer in pressure contact with said elastic member, and an axially turnable adjuster nut means coupled to said first supporter piece by means of a screw engagement for adjusting the angular relationship between said limbs and said handle riser.

2. An archery bow as claimed in claim 1 further comprising a strap interposed between the back side of said plug and the back side wall of said socket in the region of said second supporter piece.

3. An archery bow as claimed in claim 1 wherein said adjuster nut includes a face side portion arranged in surface contact with said face side wall of said socket.

* * * * *